United States Patent [19]

Maruyama

[11] Patent Number: 5,038,669

[45] Date of Patent: Aug. 13, 1991

[54] RAM PISTON WITH INTERNAL RESERVOIR AND CHECK VALVE

[75] Inventor: Tsuyoshi Maruyama, Shizuoka, Japan

[73] Assignee: Fugaku Koki Co., Ltd., Tokyo, Japan

[21] Appl. No.: 546,033

[22] Filed: Jun. 29, 1990

[30] Foreign Application Priority Data

Sep. 12, 1989 [JP] Japan ..... 1-237986

[51] Int. Cl.[5] ..... F15B 11/08; F15B 13/04

[52] U.S. Cl. ..... 91/420; 91/422; 91/440; 91/441; 92/113; 92/142

[58] Field of Search ..... 91/169, 420, 422, 440, 91/441; 92/52, 81, 113, 109, 142

[56] References Cited

U.S. PATENT DOCUMENTS

| | | | |
|---|---|---|---|
| 2,539,361 | 1/1951 | Cannon | 91/441 X |
| 3,084,512 | 4/1963 | Huelskamp | 91/441 X |
| 3,710,689 | 1/1973 | Henderson | 91/420 X |
| 4,361,075 | 11/1982 | Block | 91/420 |

*Primary Examiner*—Edward K. Look
*Assistant Examiner*—George Kapsalas
*Attorney, Agent, or Firm*—Harrison & Egbert

[57] ABSTRACT

A double-cylinder construction which can be used not only in large-sized compression molding machines but also in small-sized or medium-sized compression molding machines. In the double-cylinder construction of the present invention, a ram slidably fitted within an outer cylinder is provided in the center thereof with a hollow part. A rod slidably fitted in said hollow part is fixed to the bottom of said outer cylinder without penetrating said bottom thereof, and said rod does not contain an oil passage within. The double-cylinder construction always contains a certain amount of oil within and this self-contained oil is moved back and forth within the double-cylinder construction when the ram is being moved up and down. Therefore, the amount of oil supplied to the double-cylinder construction from outside is very small.

1 Claim, 3 Drawing Sheets

PRIOR ART

RAM PISTON WITH INTERNAL RESERVOIR AND CHECK VALVE

BACKGROUND OF THE INVENTION

The present invention relates to a double-cylinder construction in a compression molding machine for rubber, plastic, etc. In this specification and claims, said double-cylinder construction means a construction comprising an outer cylinder and a ram slidably fitted therein, said ram having a hollow part in the center thereof and serving also as an inner cylinder.

Double-cylinder constructions have been employed in large compression molding machines having a ram of a large diameter because the double-cylinder constructions have the advantage that they make it possible to use a hydraulic pump having a smaller capacity. FIG. 4 shows a typical conventional double-cylinder construction in a compression molding machine, which construction comprises an outer cylinder 1 and a ram or an inner cylinder 3 slidably fitted therein, said ram 3 being provided at the lower end thereof with a large-diameter portion 2, said ram 3 having a hollow part 4 in the center thereof, a rod 6 being fitted in said hollow part 4 so as to penetrate the bottom 5 of said outer cylinder 1, said rod 6 being slidable relative to said ram 3 and immovably fixed to the bottom of said outer cylinder 1, said rod 6 being provided in the center thereof with an oil passage 7 penetrating the rod 6 from end to end. A space formed by the lower surface of said large-diameter portion 2 of the ram 3, the inner surface of said outer cylinder 1 and the periphery of said rod 6 serves as a lower oil reservoir 8. A portion of said hollow part 4 of the ram 3 over the rod 6 serves as a ram raising oil reservoir 9. A space formed by the periphery of the ram 3 and the inner surface of the cylinder 1 serves as a ram lowering oil reservoir 10. Numeral 11 represents a check valve, and numeral 12 represents an oil tank.

In the double-cylinder construction described above, the ram 3 will be raised when an oil pressure is applied to the ram raising oil reservoir 9 through the oil passage 7 within the rod 6. The ram 3 will be lowered if an oil pressure is applied to the ram lowering oil reservoir 10 when the ram 3 is in a raised position.

In the conventional double-cylinder construction described above, the rod 6 is required to have a large diameter because the rod 6 is provided in the center thereof with the oil passage 7 penetrating the rod 6 from end to end. Furthermore, the rod 6 having a large diameter is required to penetrate the bottom 5 of the outer cylinder 1 in a state of being firmly fixed to said bottom 5. Therefore, the aforesaid conventional double-cylinder construction is used only in large-sized compression molding machines and not used in small-sized or medium-sized compression molding machines.

In the conventional double-cylinder construction described above, since all oil used for the operation thereof is supplied from outside, it is not necessarily possible to make external hydraulic apparatuses including the oil tank satisfactorily small and less expensive.

SUMMARY OF THE INVENTION

In is an object of the invention to provide a double-cylinder construction which is suitable for small-sized or medium-sized compression molding machines.

It is another object of the invention to provide a double-cylinder construction in a compression molding machine, which construction can make external hydraulic apparatuses therefor satisfactorily small and less expensive by always containing a certain amount of oil within.

These and other objects have been attained by a double-cylinder construction in a compression molding machine comprising an outer cylinder, a ram being slidably fitted within said outer cylinder, said ram being provided at the lower end thereof with a large-diameter portion and in the center thereof with a hollow part, a rod being slidably fitted in said hollow part, a space formed by the lower surface of said large-diameter portion of the ram, the inner surface of said outer cylinder and the periphery of said rod serving as a lower oil reservoir, a portion of said hollow part of the ram over said rod serving as a ram raising oil reservoir, a space formed by the periphery of said ram and the inner surface of said outer cylinder serving as a ram lowering oil reservoir, wherein said rod is fixed to the bottom of said outer cylinder without penetrating said bottom thereof, an oil passage being provided which leads from said ram raising oil reservoir to outside without passing through said rod, a self-contained oil reservoir containing a certain amount of oil being provided within said ram, said self-contained oil reservoir being connected to said lower oil reservoir through a pilot check valve, said pilot check valve usually allowing oil to flow only in the direction from said self-contained oil reservoir toward said lower oil reservoir, said ram lowering oil reservoir being connected to said pilot check valve through a pilot pressure passage, said pilot check valve allowing oil to flow in the reverse direction from said lower oil reservoir toward said self-contained oil reservoir when the pilot check valve receives a pressure of said ram lowering oil reservoir through said pilot pressure passage.

The operation of the double-cylinder construction in a compression molding machine according to the present invention will now be described.

When the ram is in the lowest position, the self-contained oil reservoir and the lower oil reservoir are respectively full of oil. In this state, if an oil pressure is applied to the ram raising oil reservoir, the ram will be moved up by reaction force because the rod is fixed to the bottom of the outer cylinder. At this time, since a negative pressure is exerted on the lower oil reservoir, oil in the self-contained oil reservoir will be sucked through the pilot check valve into the lower oil reservoir.

If an oil pressure is applied to the ram lowering oil reservoir when the ram is in a raised position, a downward force will be exerted on the ram and the ram will be moved down thereby. At this time, the pressure in the ram lowering oil reservoir will open the pilot check valve through the pilot pressure passage, and oil in the lower oil reservoir will be moved back into the self-contained oil reservoir through the pilot check valve.

Thus, oil contained in the double-cylinder construction moves back and forth between the self-contained oil reservoir and the lower oil reservoir when the ram moves up and down.

DETAILED DESCRIPTION OF THE PREFERRED EMBODIMENT

Figure 1:
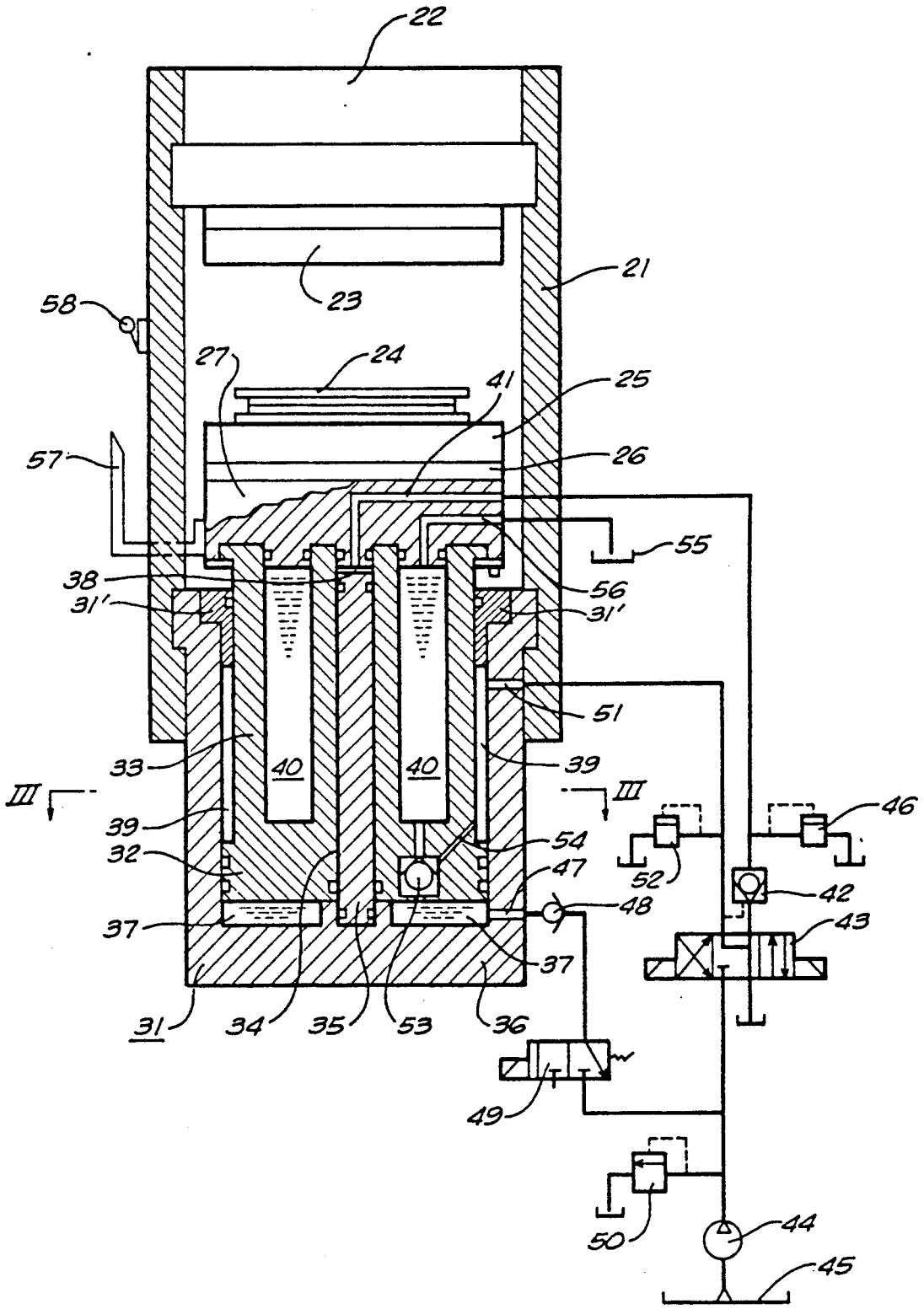
FIG. 1 is a vertical sectional view showing a double-cylinder construction according to the present invention in which a ram is in a lowered position.
Figure 2:
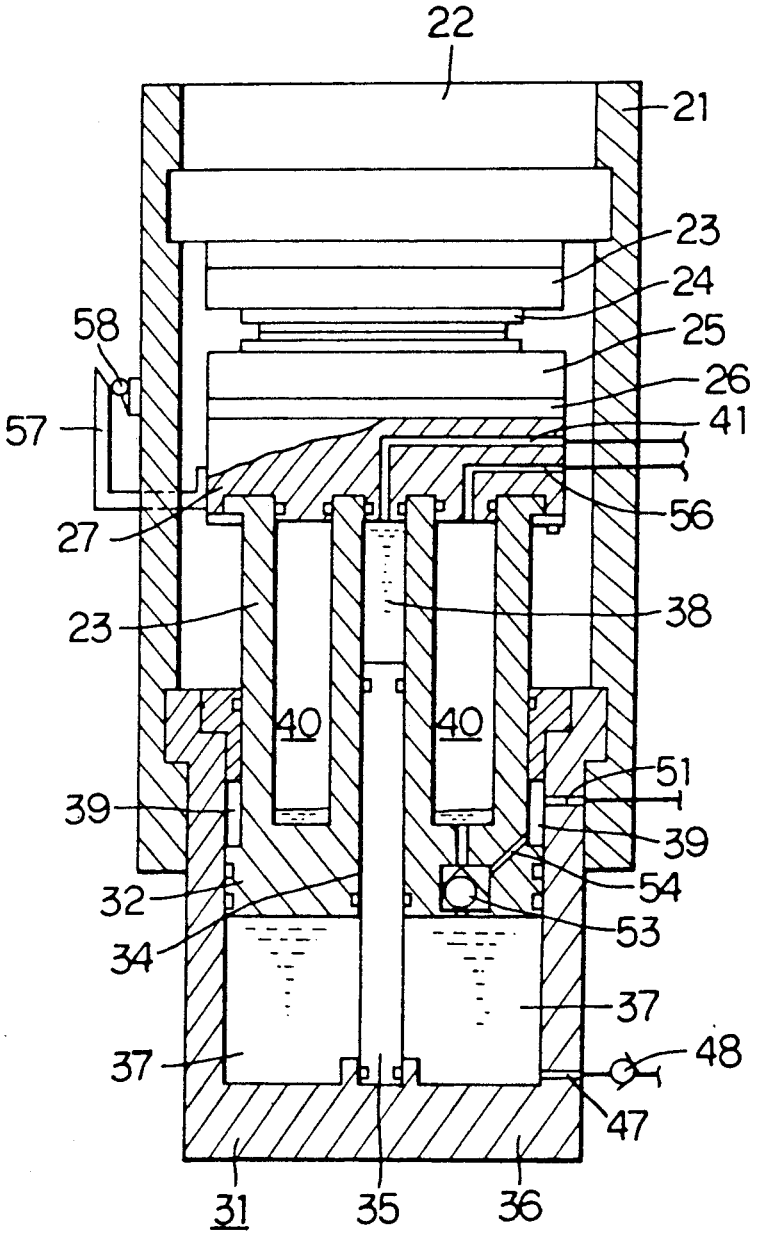
FIG. 2 is a vertical sectional view showing said double-cylinder construction in which said ram is in a raised position.
Figure 3:
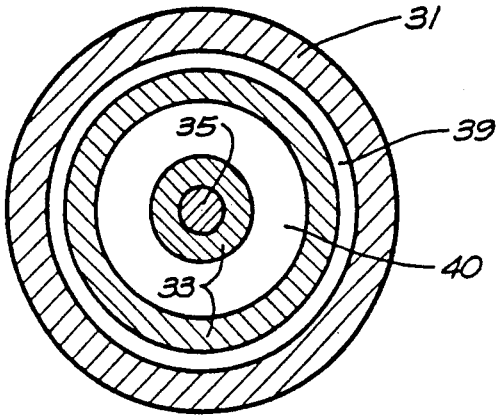
FIG. 3 is a horizontal sectional view taken on line III—III of FIG. 1.
Figure 4:
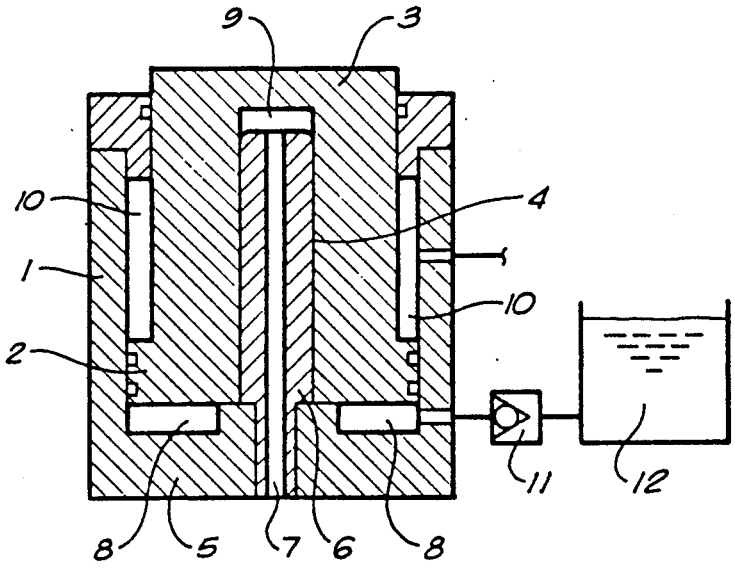
FIG. 4 is a vertical sectional view showing a conventional double-cylinder construction.

The present invention will now be described in detail with reference to the attached drawings.

A double-cylinder construction according to the present invention is used in a compression molding machine which, for example, has side plates 21, a head 22, an upper heating means 23, a mold 24, a lower heating means 25, a lower heat insulating means 26 and a movable plate 27.

An outer cylinder 31 is fixed to lower portions of the side plates 21. A ram 33, the top of which is fixed to the movable plate 27, is slidably fitted within the outer cylinder 31. The ram 33 is provided at the lower end thereof with a large-diameter portion 32 and in the center thereof with a hollow part 34. A rod 35 is slidably fitted in the hollow part 34. (Thus, the ram 33 serves also as an inner cylinder.) The rod 35 is fixed to the bottom 36 of the outer cylinder 31 without penetrating said bottom 36 thereof.

An annular space formed by the lower surface of said large-diameter portion 32 of the ram 33, the inner surface of said outer cylinder 31 and the periphery of said rod 35 serves as a lower oil reservoir 37. A portion of said hollow part 34 of the ram 33 over the rod 35 serves as a ram raising oil reservoir 38. An annular space formed by the periphery of the ram 33 and the inner surface of the outer cylinder 31 including the lower surface of a component member 31' of said outer cylinder 31 serves as a ram lowering oil reservoir 39. An annular self-contained oil reservoir 40 containing a certain amount of oil is provided within the ram 33.

An oil passage 41 is provided which leads from said ram raising oil reservoir 38 to outside without passing through the rod 35. Said oil passage 41 penetrates, for example, the movable plate 27 over the ram 33 and leads through a check valve 42 and a direction control valve 43 to an oil pump 44. Numeral 45 represents an oil tank, and numeral 46 represents a relief valve.

An oil passage 47 is provided which leads from said lower oil reservoir 37 to outside. Said oil passage 47 leads through a check valve 48 and a direction control valve 49 to said oil pump 44. Numeral 50 represents a relief valve.

An oil passage 51 is provided which leads from said ram lowering oil reservoir 39 to outside. Said oil passage 51 leads through the direction control vlave 43 to said oil pump 44. Numeral 52 represents a relief valve.

An oil passage 56 is provided which leads from said self-contained oil reservoir 40 to an external oil tank 55.

Said self-contained oil reservoir 40 within the ram 33 is connected to said lower oil reservoir 37 through a pilot check valve 53. Said pilot check valve 53 usually allows oil to flow only in the direction from the self-contained oil reservoir 40 toward the lower oil reservoir 37. Said ram lowering oil reservoir 39 is connected to the pilot check valve 53 through a pilot pressure passage 54. The pilot check valve 53 allows oil to flow in the reverse direction from the lower oil reservoir 37 toward the self-contained oil reservoir 40 when said pilot check valve 53 receives a pressure of the ram lowering oil reservoir 39 through the pilot pressure passage 54.

When the ram 33 is to be moved up, oil is sent by the oil pump 44 through the direction control valve 43 and the oil passage 41 into the ram raising oil reservoir 38. The pressure of oil sent into the ram raising oil reservoir 38 is adjusted by means of the relief valve 46 to a low pressure necessary to raise the ram 33 with the pressed area of the top of the rod 35.

Now, means for reducing the rising speed of the ram 33 before the mold 24 contacts the upper heating means 23 will be described. A projection 57 is attached to the movable plate 27, and a limit switch 58 corresponding to the projection 57 is disposed on one of the side plates 21. The projection 57 will contact and actuate the limit switch 58 before the mold 24 in the upstroke contacts the upper heating means 23. Then, the direction control valve 43 will return to neutral and stop oil supply to the ram raising oil reservoir 38. At the same time, another direction control valve 49 will allow oil to flow through the check valve 48 and the oil passage 47 into the lower oil reservoir 37. If the lower oil reservoir 37 is larger in area than the ram raising oil reservoir 38, then the rising speed of the ram 33 will be reduced thereby.

When the ram 33 is to be moved down, the direction control valve 43 is changed over so as to send oil through the oil passage 51 into the ram lowering oil reservoir 39 and at the same time the direction control valve 49 is returned to neutral. Now, oil in the lower oil reservoir 37 is prevented from flowing out of the outer cylinder 31 by the check valve 48 and will be returned through the pilot check valve 53 to the self-contained oil reservoir 40 when the ram 33 is being moved down.

When the ram 33 is being moved down, the hydraulic pump 44 will send a small amount of oil through the ram lowering oil reservoir 39, the pilot pressure passage 54 and the pilot check valve 53 into the lower oil reservoir 37. However, such an increased amount of oil will be returned through the oil passage 56 to the external oil tank 55. Therefore, the amount of oil contained in the double-cylinder construction remains constant even when the compression molding machine is repeatedly operated.

According to the present invention, the rod slidably fitted in the hollow part within the ram can be made smaller in diameter because the rod does not have an oil passage in the center thereof. Also, the rod does not penetrate the bottom of the outer cylinder and the rod is simply fixed to the bottom of the outer cylinder. Therefore, the double-cylinder construction of the present invention can be used not only in large-sized compression molding machines but also in small-sized or medium-sized compression molding machines.

Furthermore, according to the present invention, the amount of oil supplied to the double-cylinder construction from outside is very small because the double-cylinder construction always contains a certain amount of oil within and this self-contained oil is moved back and forth within the double-cylinder construction when the ram is being moved up and down. Therefore, it is possible to make external hydraulic apparatuses including the oil tanks very small and less expensive.

What is claimed is:

1. A double-cylinder construction in a compression molding machine comprising an outer cylinder (31), a ram (33) being slidably fitted within said outer cylinder, said ram being provided at the lower end thereof with a large-diameter portion (32) and in the center thereof with a hollow part (34), a rod (35) being slidably fitted in said hollow part, a space formed by the lower surface of said large-diameter portion of the ram, the inner surface of said outer cylinder and the periphery of said rod serving as a lower oil reservoir (37), a portion of said hollow part of the ram over said rod serving as a ram raising oil reservoir (38), a space formed by the periphery of said ram and the inner surface of said outer cylinder serving as a ram lowering oil reservoir (39), wherein said rod (35) is fixed to the bottom (36) of said outer cylinder (31) without penetrating said bottom thereof, an oil passage (41) being provided which leads from said ram raising oil reservoir (38) to outside without passing through said rod, a self-contained oil reservoir (40) containing a certain amount of oil being provided within said ram, said self-contained oil reservoir being connected to said lower oil reservoir (37) through a pilot check valve (53), said pilot check valve usually allowing oil to flow only in the direction from said self-contained oil reservoir toward said lower oil reservoir, said ram lowering oil reservoir being connected to said pilot check valve through a pilot pressure passage (54), said pilot check valve allowing oil to flow in the reverse direction from said lower oil reservoir (37) toward said self-contained oil reservoir (40) when the pilot check valve receives a pressure of said ram lowering oil reservoir (39) through said pilot pressure passage.

* * * * *